US007238087B1

(12) United States Patent
Kashiwa et al.

(10) Patent No.: US 7,238,087 B1
(45) Date of Patent: Jul. 3, 2007

(54) PLANARIZING DEVICE AND A PLANARIZATION METHOD FOR SEMICONDUCTOR SUBSTRATES

(75) Inventors: Moriyuki Kashiwa, Annaka (JP); Hirotaka Okonogi, Annaka (JP); Kazuo Kobayashi, Annaka (JP)

(73) Assignee: Okamoto Machine Tool Works, Ltd., Annaka (JP)

( * ) Notice: Subject to any disclaimer, the term of this patent is extended or adjusted under 35 U.S.C. 154(b) by 0 days.

(21) Appl. No.: 11/608,106

(22) Filed: Dec. 7, 2006

(30) Foreign Application Priority Data

Mar. 29, 2006 (JP) ..... 2006-090114

(51) Int. Cl.
*B24B 1/00* (2006.01)

(52) U.S. Cl. ..... 451/41; 451/57; 451/65; 451/287

(58) Field of Classification Search ..... 451/5, 451/11, 41, 57, 65, 66, 388, 398
See application file for complete search history.

(56) References Cited

U.S. PATENT DOCUMENTS

| | | | | |
|---|---|---|---|---|
| 6,165,056 | A | 12/2000 | Hayashi et al. | |
| 6,358,131 | B1 * | 3/2002 | Sakurai et al. | 451/287 |
| 6,379,230 | B1 | 4/2002 | Hayashi et al. | |
| 6,398,626 | B1 * | 6/2002 | Matsuo et al. | 451/66 |
| 6,431,964 | B1 | 8/2002 | Ishikawa et al. | |
| 6,520,895 | B2 * | 2/2003 | Senga et al. | 483/1 |
| 6,827,633 | B2 * | 12/2004 | Wada et al. | 451/41 |
| 6,916,231 | B2 * | 7/2005 | Wakabayashi | 451/66 |
| 7,063,598 | B2 * | 6/2006 | Isobe et al. | 451/54 |
| 2005/0118938 | A1 | 6/2005 | Mizomoto et al. | |

FOREIGN PATENT DOCUMENTS

| | | |
|---|---|---|
| JP | 60-76959 | 1/1985 |
| JP | 2000-225561 | 8/2000 |
| JP | 2000-254857 | 9/2000 |
| JP | 2002-151450 | 5/2002 |
| JP | 2005-098773 A | 4/2005 |
| JP | 2005-153090 | 6/2005 |

* cited by examiner

*Primary Examiner*—Dung Van Nguyen
(74) *Attorney, Agent, or Firm*—Oblon, Spivak, McClelland, Maier & Neustadt, P.C.

(57) ABSTRACT

A substrate-planarizing device and method of using the device comprising a substrate storage stage outside a room, and on a base inside the room, a multi-joint transfer robot, a temporary alignment platform, a movable transfer pad, a grinding process stage in which substrate holders that compose three stages of a substrate loading/unloading stage, a rough grinding stage, a finish grinding stage are arranged in a concentric pattern on the first index rotary table, and a polishing process stage that has a substrate holder table composing a substrate loading/unloading/finish polishing stage as well as a substrate holder table composing a rough polishing stage arranged in a concentric pattern on the second index rotary table.

12 Claims, 6 Drawing Sheets

PLANARIZING DEVICE AND A PLANARIZATION METHOD FOR SEMICONDUCTOR SUBSTRATES

CROSS REFERENCE TO RELATED APPLICATION

The present application claims priority to Japanese Patent Application No. JP 2006-090114, filed Mar. 29, 2006, the entire contents of which are incorporated herein by reference.

BACKGROUND OF THE INVENTION

1. Field of the Invention

The present invention relates to a planarizing device and method, which is used for thinning and planarizing substrates by grinding and polishing the back surface of the semiconductor substrates in a preprocessing process of IC substrates.

2. Description of the Related Art

In a background planarizing device, semiconductor substrates are ground/polished for thinning and mirror finishing. Multiple substrate holder tables can retain substrates by vacuum suction are arranged in a lower side, and a rotating spindle comprising a rough grinding wheel, a rotating spindle comprising a finish grinding wheel, and a rotating spindle comprising polishing equipments is arranged on top of each of multiple substrate holder tables. A multi-joint transfer robot transfers the substrates that are stored in a substrate storage cassette to a temporary alignment table. Transfer equipment comprising transfer pads, which transfer substrates on the substrate holder table to the next processing stage, and a substrate cleaning device, is included with the planarizing device.

In one example, a device uses a plane grinding/polishing device comprising four sets of substrate holder tables. The tables can vacuum chuck five sheets of small diameter semiconductor substrates, and are arranged equally spaced on the same circumference from the shaft center of one index rotary table. The index rotary table is partitioned in a loading/unloading stage A, the first rough grinding stage B, the second finish grinding stage C, and a polishing stage D. It is typical to sequentially perform the process, which includes loading of the semiconductor substrates, with a multi-joint transfer robot to each substrate holder table on each stage accompanying the 90° rotation of the index rotary table, rough grinding process of the substrate back surfaces by rough grinding wheels, finish grinding of the substrate back surfaces by finish grinding wheels, mirror polishing by polishing pads and unloading by a transfer device. In this plane grinding/polishing device, each diameter of the rough grinding flat wheel, the finish grinding flat wheel and the polishing pads that are used, are larger than the diameter of the substrate holder table (for example, see Japanese Unexamined Patent Publication No. S60-76959).

As the diameter of the semiconductor substrates became larger up to 200 mm (8 inches), and one semiconductor substrate is placed on each of the four sets of substrate holder tables that are set on the index rotary tables, a planarizing device comprising a rough grinding diamond cup wheel, a finish grinding diamond cup wheel, and a polishing pad is provided. As shown in FIG. 1 and FIG. 2 of Japanese Unexamined Patent Publication No. 2000-254857, this planarizing device is a plane grinding/polishing device 10. Four sets of substrate holder tables 32, 36, 38, 40, which can vacuum chuck one sheet of the semiconductor substrate, are arranged on an index rotary table 34 equally spaced on the same circumference from the shaft center of the index rotary table 34. The index rotary table 39 is partitioned into the loading/unloading stage 17, the rough grinding stage 18, the finish grinding stage 20 and the polishing stage 22. The diameter of the rough grinding wheel 46, the finish grinding wheel 54, and the polishing pad 56 are 1-1.3 times the diameter of the substrate holder tables (for example, see Japanese Unexamined Patent Publication No. 2000-254857, which corresponds to U.S. Pat. No. 6,481,964 B).

In the planarizing device 510, which can plane grind/polish the substrate as shown in FIG. 5 and FIG. 6 of this application, from the front, 526 is a loading port (storage cassette) and an unloading port (storage cassette), 514 is a cassette storage stage, 528 is a semiconductor substrate, 512 is a base, 516 is a substrate alignment stage (temporary placement base), 523 is a polishing pad cleaning stage, 524 is a cleaning stage, 530 is a ceiling pendant multi-joint transfer robot, 558 is a travel rail, 597 is a transfer robot, 534 is an index rotary table, 537 is an axis of spindle of the index rotary table, 532, 536, 538, and 540 are substrate holder tables, 523 is a polishing pad cleaning device, and 527 is a polishing pad dressing stage.

Using this planarizing device 510, the process of grinding and polishing the back surface of the semiconductor substrate 528 is to seize and grip one sheet of the semiconductor substrate 528 stored in the loading port 526 in the cassette storage stage 514 with the hand 531 of the ceiling pendant multi-joint transfer robot 530, transfer them to the substrate alignment stage (temporary placement base) 516, and align the semiconductor substrate 528 there. After alignment, the semiconductor substrate 528 is again seized and gripped by the hand 531 of the multi-joint transfer robot 530, transferred to the substrate holder (vacuum chuck) 532 in the location of the loading/unloading stage 517 of the index rotary table 534, and seized and gripped by the substrate holder 532.

Next, the process includes rotating the index rotary table 534 90° clockwise, guiding the substrate holder 532, in which the semiconductor substrate 528 is placed at the location of the substrate holder (vacuum chuck) 536 of the first rough grinding stage 518, and rotating the rough grinding diamond cup wheel 46 there, and declining it to slit grind the back surface of the semiconductor substrate. When the thickness of the semiconductor substrate has reached the approximate desired thickness (for example, 100-250 μm, or 30-120 μm), the rough grinding diamond cup wheel 546 is elevated and removed from the back surface of the semiconductor substrate.

The rough ground semiconductor substrate 528 is transferred to the location of the substrate holder (vacuum chuck) 538 of the second finish grinding stage 520 by rotating the index rotary table 534 90° clockwise, and there, the finish grinding diamond cup wheel 554 is declined as it spins to slit grind to a thickness of approximately 10-20 μm from the back surface of the semiconductor substrate. When the thickness of the semiconductor substrate has reached the approximate desired thickness (for example, 80-220 μm, or 20-100 μm), the finish grinding diamond cup wheel 554 is elevated and removed from the back surface of the semiconductor substrate.

The finish ground semiconductor substrate 528 is transferred to the location of the substrate holder (vacuum chuck) 540 of the polishing stage 522 by rotating the index rotary table 534 90° clockwise, and there, by oscillating the rotating polishing pad 556, the surface of the finish ground substrate is polished to a thickness of 5-10 μm, which removes grinding defects. After polishing to a mirror surface, the polishing pad 556 is removed from the back surface of the semiconductor substrate.

The mirror polished semiconductor substrate 528 is returned to the first location of the substrate holder 532 of the loading/unloading stage 517 by rotating the index rotary table 534 90° clockwise, and being seized by the suction pad of the multi-joint transfer robot 597, it is transferred to the cleaning stage 524. There, the ground/polished surface is cleaned and dried. Next, after again being seized by the suction pad of the multi-joint transfer robot 597, it is transferred to the unloading port 526 and stored in the storage cassette 526.

After rotating each index rotary table 534 90° clockwise, loading and unloading of the semiconductor substrate, a rough grinding process, a finish grinding process, and a polishing process are performed at each stage. Moreover, the polishing pad 556 is cleaned in the polishing pad cleaning stage 523, the cleaned polishing pad 556 is dressed, and the chuck surface of the substrate is cleaned by the chuck cleaner 542 in the polishing pad dressing stage 527. In addition, the common machining allowance of planarized substrate layer by polishing is 8-13 μm, which is enough for grinding marks to disappear.

Although it depends on the manufacturer, currently, the diamond cup wheels used in grinding are cup wheels with 360 mesh grit grain size as the rough grinding diamond cup wheel 546, and cup wheels with 1,500 mesh grit grain size as the finish grinding diamond cup wheel 554 for plane grinding the back surfaces of the substrate, or cup wheels with 325 mesh grit grain size as the rough grinding wheel. Cup wheels with 2,000 mesh grit grain size as the finish grinding wheel for plane grinding the substrate back surfaces.

As a planarizing device resembling the planarizing device of Japanese Unexamined Patent Publication No. 2000-254857, a planarizing device is also proposed comprising four substrate holder tables (vacuum chuck) arranged on the same index rotary table, wherein one of the substrate holder tables is used as a loading/unloading stage for the substrates, and the remaining three substrate holder tables are each set up with a rotating spindle comprising a rough grinding diamond cup wheel, a rotating spindle comprising a finish grinding diamond cup wheel, and a rotating spindle comprising a dry polishing flat wheel. In this planarizing device, the rotating spindle comprising a dry polishing flat wheel is situated on the substrate holder table of the polishing stage allotted to the fourth polishing stage in a way possible to move in a direction perpendicular to the retention surface and is able to vacillate linearly (reciprocate) in a direction parallel to the retention surface (for example, see Japanese Unexamined Patent Publication No. 2005-153090, which corresponds to U.S. Pat. No. 7,022,000).

Moreover, an in-line system substrate back surface planarizing device is also proposed, comprising a substrate holder table (vacuum chuck) on an index rotary table for rough grinding and finish grinding of the back surface of a semiconductor substrate, a substrate holder table that is set separately from the index rotary table for polishing process, and a surface inspection device, which detects the presence of cracks or scratches on the semiconductor substrate at the time of transferring thinned semiconductor substrates to a mount device (for example, see Japanese Unexamined Patent Publication No. 2005-98773).

With a substrate diameter of 12 inches (300 mm) or 16 inches (450 mm), and a thickness of 20-50 μm, as is desired for production of extremely thin semiconductor substrates for the next generation, the creation of a grinding/polishing planarizing device, which is able to planarize the back surface of a sheet of semiconductor substrate faster (high throughput), and has a small footprint of the grinding/polishing planarizing device, is desired by semiconductor manufactures.

In a built-in system planarizing device, wherein the grinding/polishing process stated in Japanese Unexamined Patent Publication No. S60-76959, Japanese Unexamined Patent Publication No. 2000-254857 and Japanese Unexamined Patent Publication No. 2005-153090 are carried out on the substrate holder tables that are arranged in tiers on the same index rotary table, has the advantage of having a smaller footprint than that of the in-line system planarizing device. The grinding process described in Japanese Unexamined Patent Publication No. 2005-98773 is performed on the substrate holder on the index rotary table, and the polishing process is performed on the other substrate holder table, but its throughput is 12-13 sheets per hour with a 300 mm diameter substrate and it is inferior compared to 15-16 sheets per hour of an in-line system planarizing device. Moreover, because the grinding and the polishing are carried out on the same holder table, the holder tables and the processing tools get soiled faster, and there is a shortcoming of inferior planarization accuracy.

The planarizing device described in Japanese Unexamined Patent Publication No. 2000-254857 has advantages of being a little smaller and causes less damage to the processed substrate than the planarizing device described in Japanese Unexamined Patent Publication No. 2005-153090. The planarizing device of Japanese Unexamined Patent Publication No. 2005-153090, which uses dry polish for the polishing process has an advantage of being environmentally-friendly because there is no need to use an abrasive fluid slurry, but due to dry polishing without the use of abrasive slurry fluid, in order to prevent deterioration of the substrate from the heat generated while the substrate is processed, a procedure is necessary for cooling the substrates with cool air, and its footprint is a little larger than that of the planarizing device of Japanese Unexamined Patent Publication No. 2000-254857, and its throughput is inferior.

One aspect of the present invention embodies further improvement of the throughput of substrates with almost no increase in the footprint of the line system planarizing device, described in Japanese Unexamined Patent Publication No. 2005-98773.

In order to realize high throughput, the inventors focused attention on the fact that the polishing process is rate-controlled by the grinding process, and a shorter throughput than that of the planarizing device described in Japanese Unexamined Patent Publication No. 2005-98773 is enabled by dividing the polishing process into the first (rough) polishing process and second (finish) polishing process, in addition to having the first polishing process rate-controlled by the second polishing process.

One aspect of the present invention includes a planarizing device with high throughput as well as a limited increase in footprint and a system using the planarizing device for planarizing the back surface of the semiconductor substrate as its objectives.

SUMMARY OF THE INVENTION

A semiconductor substrate planarizing device includes, a substrate storage stage at least partially outside a room. The semiconductor substrate planarizing device further includes a multi-joint transfer robot, a temporary alignment platform, a grinding process stage, a movable transfer pad, a polishing process stage, and a cleaning stage inside the room. The substrate storage stage is set on the first side of the outside of the room, facing the rear of the planarizing device. Inside the room, the multi-joint transfer robot is situated such that the multi-joint transfer robot can reach and remove substrates from the substrate storage stage in a front row inside of the room. The temporary alignment platform is situated on a first side of the row behind the multi-joint transfer robot, and the movable transfer pad is situated in a center of a back row. The grinding process stage, which has first, second, and third substrate holder tables, comprising 1) a substrate loading/unloading stage, 2) a rough grinding stage, and 3) a finish grinding stage, respectively, is set in a clockwise direction arranged in a concentric pattern on a first index rotary table in a last row.

A cleaning device comprising a rotary chuck cleaner is configured to clean a top surface of the first substrate holder table, and a pair of rotary cleaning brushes is configured to clean the surface of a ground substrate. The cleaning device is configured to be moved in perpendicular and parallel directions relative to the top surface of the first substrate holder table.

A spindle comprising a rough grinding diamond cup wheel is set on top of the second substrate holder table and is configured to move up-and-down with respect to the top surface of the second substrate holder table.

A spindle comprising a finish grinding diamond cup wheel is set on top of the third substrate holder table and is configured to move up-and-down in relation to the top surface of the third substrate holder table.

The substrate loading/unloading stage includes the first substrate holder table, a multi-joint transfer robot, a movable transfer pad, and a cleaning device comprising a rotary chuck cleaner and a rotary cleaning brush.

The rough grinding stage includes the second substrate holder table and a rough grinding diamond cup wheel.

The finish grinding stage includes the third substrate holder table and a finish grinding diamond cup wheel.

The semiconductor substrate planarizing device includes a polishing process stage, in which a fourth substrate holder table comprising a substrate loading/unloading/finish polishing stage and fifth substrate holder table comprising a rough polishing stage are arranged in a concentric pattern on a table of a second index rotary table on a second side of the multi-joint transfer robot, opposite the first side.

A spindle, that axially supports a cleaning fluid feeding mechanism and a polishing pad so as to permit the cleaning fluid feeding mechanism and polishing pad to rotate freely is set on top of the fourth substrate holder table. The spindle is configured to move up-and-down and vacillate parallel to the top surface of the fourth substrate holder table, and a substrate loading/unloading/finish polishing stage includes the fourth substrate holder table, a polishing pad, a cleaning fluid feeding mechanism, the movable transfer pad and the multi-joint transfer robot or another transfer pad or another multi-joint transfer robot, and a spindle, that axially supports an abrasive slurry fluid feeding mechanism and the polishing pad so as to permit them to rotate freely, is set on top of the fifth substrate holder table and is configured to move up-and-down and vacillate parallel to the top surface of the second substrate holder table.

One non-limiting embodiment of the invention includes a method of thinning/planarizing a back surface of a semiconductor substrate using a claimed substrate planarizing device. The method typically includes processes 1-13 as follows.

Process 1 typically includes seizing a substrate that is stored in a storage cassette of the substrate storage stage with suction/gripping pads of the multi-joint transfer robot, and transferring the substrate to a temporary alignment platform to control a center position of the substrate such that centers of the substrate are aligned.

Process 2 typically includes seizing a top surface of the aligned substrate with the suction/gripping pads of the multi-joint transfer robot, and then transferring the substrate to the top of the first substrate holder table.

Process 3 typically includes, by rotating the first index rotary table, transferring a vacuum chucked substrate on the substrate holder table located in the substrate loading/unloading stage to the second substrate holder table;

Process 4 typically includes roughly grinding the back surface of the substrate using diamond cup wheels in the rough grinding stage, wherein process 1) and process 2) are performed using the multi-joint transfer robot during this stage, and a new substrate is transferred to the substrate loading/unloading stage.

Process 5 typically includes, by rotating the first index rotary, transferring the roughly ground substrate to the third substrate holder table, and at the same time, transferring the substrate on the first substrate holder table to the rough grinding stage.

Process 6 typically includes finish grinding the back surface of the substrate using a diamond cup wheel in the finish grinding stage, wherein the back surface of the substrate is roughly ground using the diamond cup wheels in the rough grinding stage during this stage, and at the same time, a new substrate is transferred by the multi-joint transfer robot to the top of the first substrate holder table via a temporary alignment platform.

Process 7 typically includes, by rotating the first index rotary table, transferring the finish ground substrate to the substrate loading/unloading stage, and transferring the roughly ground substrate to the finish grinding stage.

Process 8 typically includes, by moving a rotary cleaning brush to the top surface of the finish ground substrate on the first substrate holder table, cleaning the top surface of the substrate by supplying cleaning fluid to the top surface of the substrate, and then seizing the ground/cleaned top surface of the substrate with the suction pads of the movable transfer pad, and then transferring to the top of the fourth substrate holder table, which is set in the second index rotary table, wherein while these substrates are transferred, the top surface of the first substrate holder table is cleaned by a rotary ceramic chuck cleaner, and after cleaning the top surface of the substrate holder, the abovementioned first process and second process are initiated consecutively, in which the new substrate is transferred to the top of the substrate holder table in the location of the substrate loading/unloading stage via the temporary alignment platform by the multi-joint transfer robot, in addition, the fourth process of rough grinding is performed on the substrate on top of the substrate holder table in the location of the rough grinding stage of the first index rotary table, and at the same time, the sixth process of finish grinding is performed on the substrate on top of the substrate holder table in the location of the finish grinding stage of the first index rotary table.

Process 9 typically includes, after the rough grinding process of the substrate, rotating the second index rotary table 180° clockwise or counterclockwise, and transferring the ground/cleaned substrate to the location of the rough polishing stage of the second index rotary table, wherein the abovementioned seventh process is implemented simultaneously with this operation.

Process 10 typically includes moving the rotating rough polishing pad to the top surface of the substrate on top of the substrate holder table in the location of the rough polishing stage set on the second index rotary table, and rubbing the surface of the substrate, wherein while the substrate and the rough polishing pad are rubbed, abrasive slurry fluid, in which abrasive grains are dispersed in water, is fed directly from an abrasive slurry fluid feeding mechanism to the top surface of the substrate, or via the rough polishing pad to the top surface of the substrate, and at the same time, the rough polishing pad rubs while vacillating (reciprocating) on the top surface of the substrate, and the abovementioned eighth processing is implemented simultaneously.

Process 11 typically includes rotating the second index rotary table, and transferring the roughly ground substrate to the location of the substrate loading/unloading/finish grinding stage of the second index rotary table at the same time, by rotating the first index rotary table, transporting the finish ground substrate to the substrate loading/unloading stage, transporting the roughly ground substrate to the finish grinding stage, and transporting the substrate on the substrate loading/unloading stage to the rough grinding stage.

Process 12 typically includes, at the substrate loading/unloading/finish grinding stage of the second index rotary table, moving the rotating finish polishing pad to the top surface of the rough polished substrate retained on the substrate holder table, and rubbing the surface of the substrate, wherein while the substrate and the finish polishing pad are rubbed, cleaning fluid, which does not contain abrasive grain, is fed to the top surface of the substrates directly from the cleaning fluid feeding mechanism, or fed via a polishing cloth or a urethane foam sheet pad of the finish polishing pad to the top surface of the substrate while the finish polishing pad is vacillating, the finish polished substrate is transferred to the next processing stage using substrate transfer equipment having suction pad on an arm, or the multi-joint transfer robot; seizing the ground/cleaned substrate on the substrate holder table in the location of the substrate loading/unloading stage of the first index rotary table with movable suction/gripping pad after emptying the substrate holder table in the location of the substrate loading/unloading/finish grinding stage of the second index rotary table, and then transferring to the top of the substrate holder table located in the substrate loading/unloading/finish grinding stage set on the second index rotary table, wherein the abovementioned tenth process including the eighth process is implemented concurrently at each stage of the first index rotary table and the rough polishing stage of the second index rotary table.

Process 13 typically includes after processes 11 and 12, the repeating abovementioned eleventh process and the twelfth process to perform consecutive operations of thinning and planarizing substrates by grinding/cleaning/polishing the substrate surface of the semiconductor substrates.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
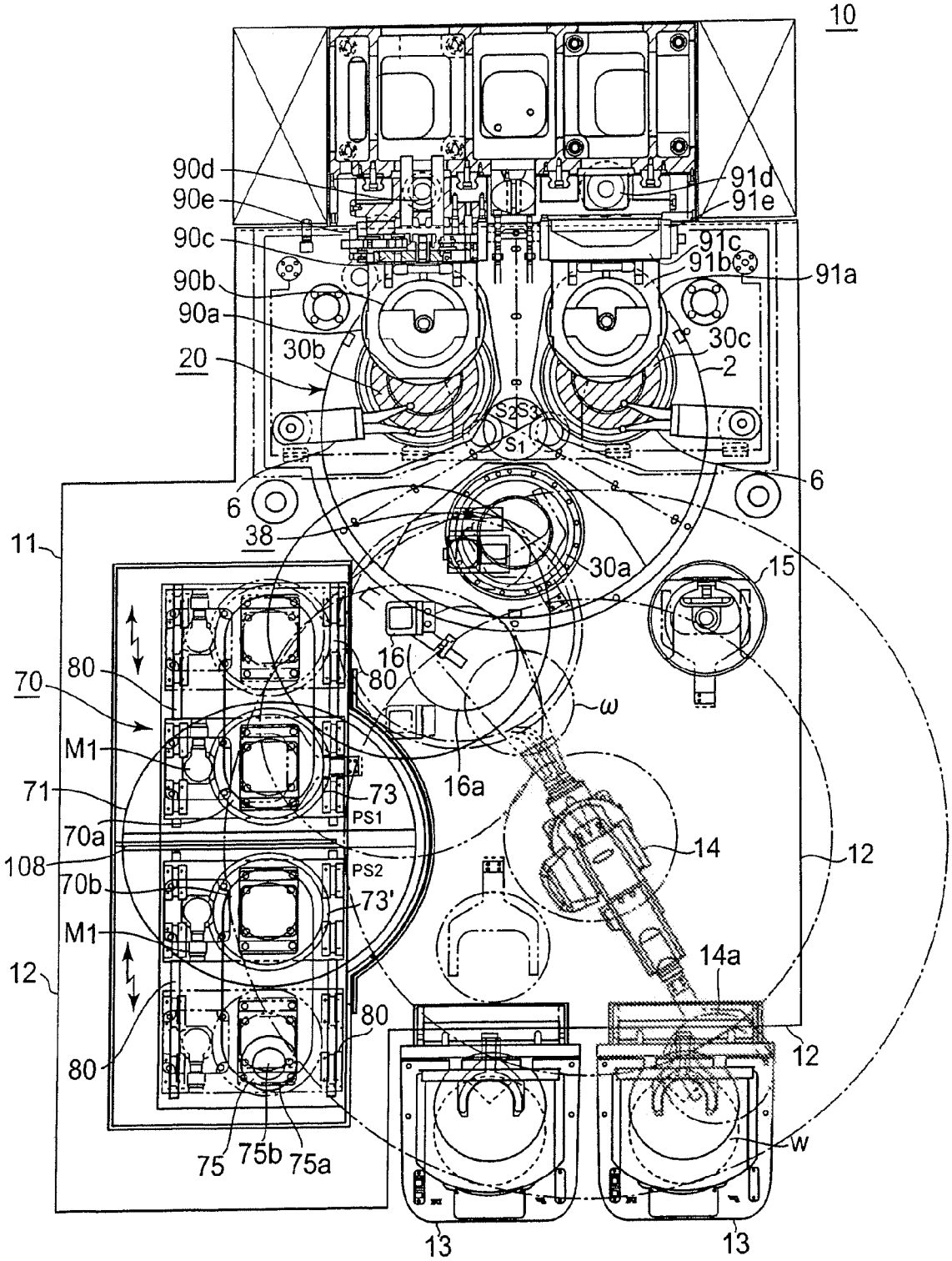
FIG. 1 is a plan view of one aspect of the substrate-planarizing device of the present invention, wherein a grinding stage and a polishing stage are systemized in an in-line fashion.

Referring now to the drawings, wherein like reference numerals designate identical or corresponding parts throughout the several views.

Figure 2:
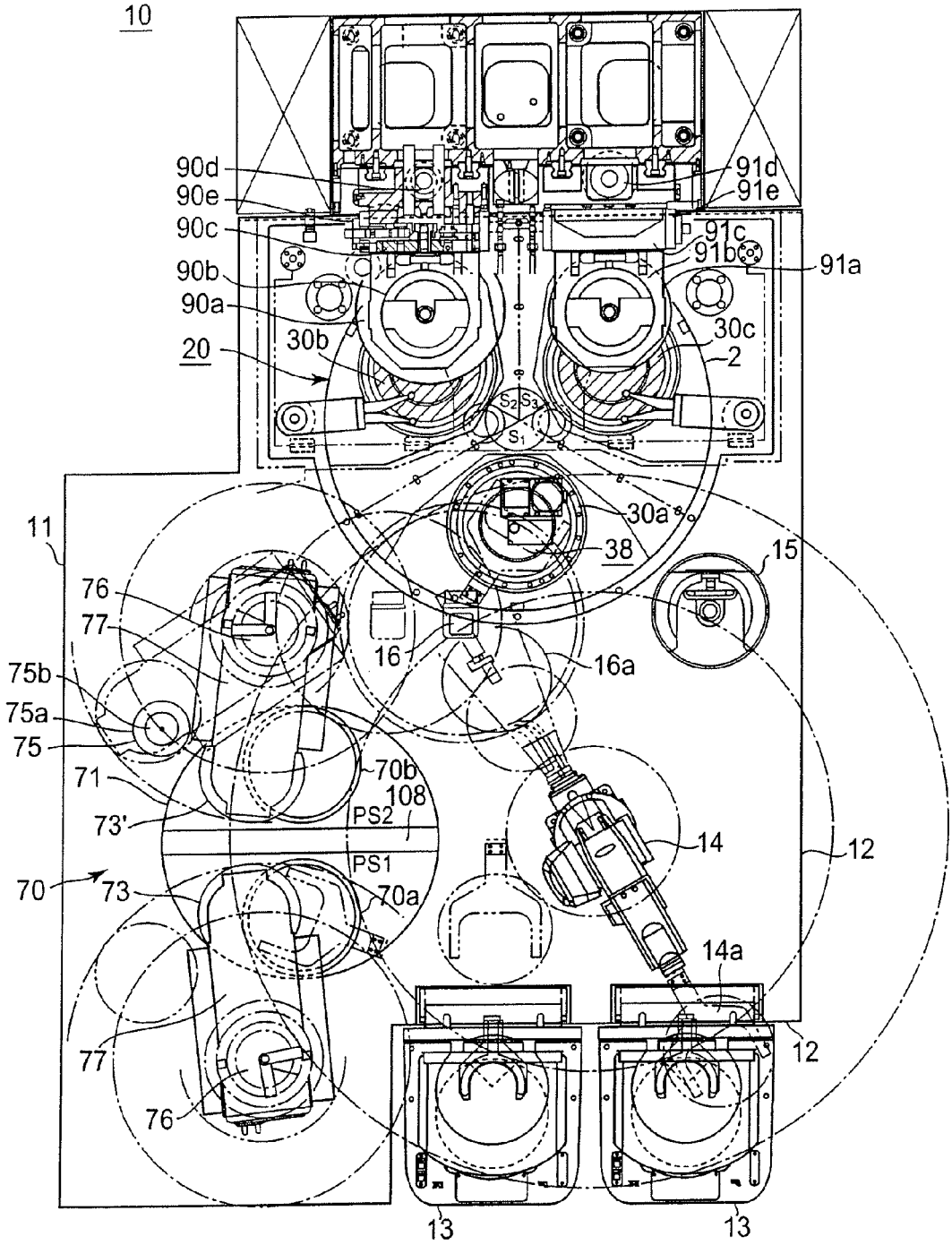
FIG. 2 is a plan view that shows the other aspect of the substrate-planarizing device.

In the back area of two non-limiting embodiments of the semiconductor substrate-planarizing device 10 shown in FIG. 1 and FIG. 2, the planarizing device 10 is composed of the substrate storage stage 13 outside of the room divider 12, and inside of the room divider 12 on the base 11, the multi-joint transfer robot 14, the temporary alignment platform 15, the grinding process stage 20, the movable transfer pad 16, the polishing process stage 70, and the cleaning device 38 inside the room. It is typically possible to store 25 sheets of the substrates inside of the storage cassette of the substrate storage stage 13.

In each stage, toward the rear from the front of the planarizing device 10, the substrate storage stage 13 is typically set on the right side of the outside of the room, and the multi-joint transfer robot 14 equipped with the suction/gripping arm 14*a* is set in the nearby location of the substrate storage stage in a front row of the room. The temporary alignment platform 15 is typically set on the right side of row behind the multi-joint transfer robot ($2^{nd}$ row), and the movable transfer pad 16 is set in the center of a row behind the grinding process stage 20. Substrate holders 30*a*, 30*b*, 30*c* compose the three stages of the substrate loading/unloading stage $S_1$, the rough grinding stage $S_2$, and the finish grinding stage $S_3$ in a clockwise direction and are arranged in a concentric pattern on the first index rotary table in the front-most row. Moreover, the polishing process stage 70, wherein the substrate holder table 70*a*, which composes a substrate loading/unloading/finish polishing stage $ps_1$ and the substrate holder table 70*b*, which composes a rough polishing stage $ps_2$, are arranged in a concentric pattern on the table of the second index rotary table 71 on the left side of the multi-joint transfer robot as shown in FIG. 3.

Figure 3:
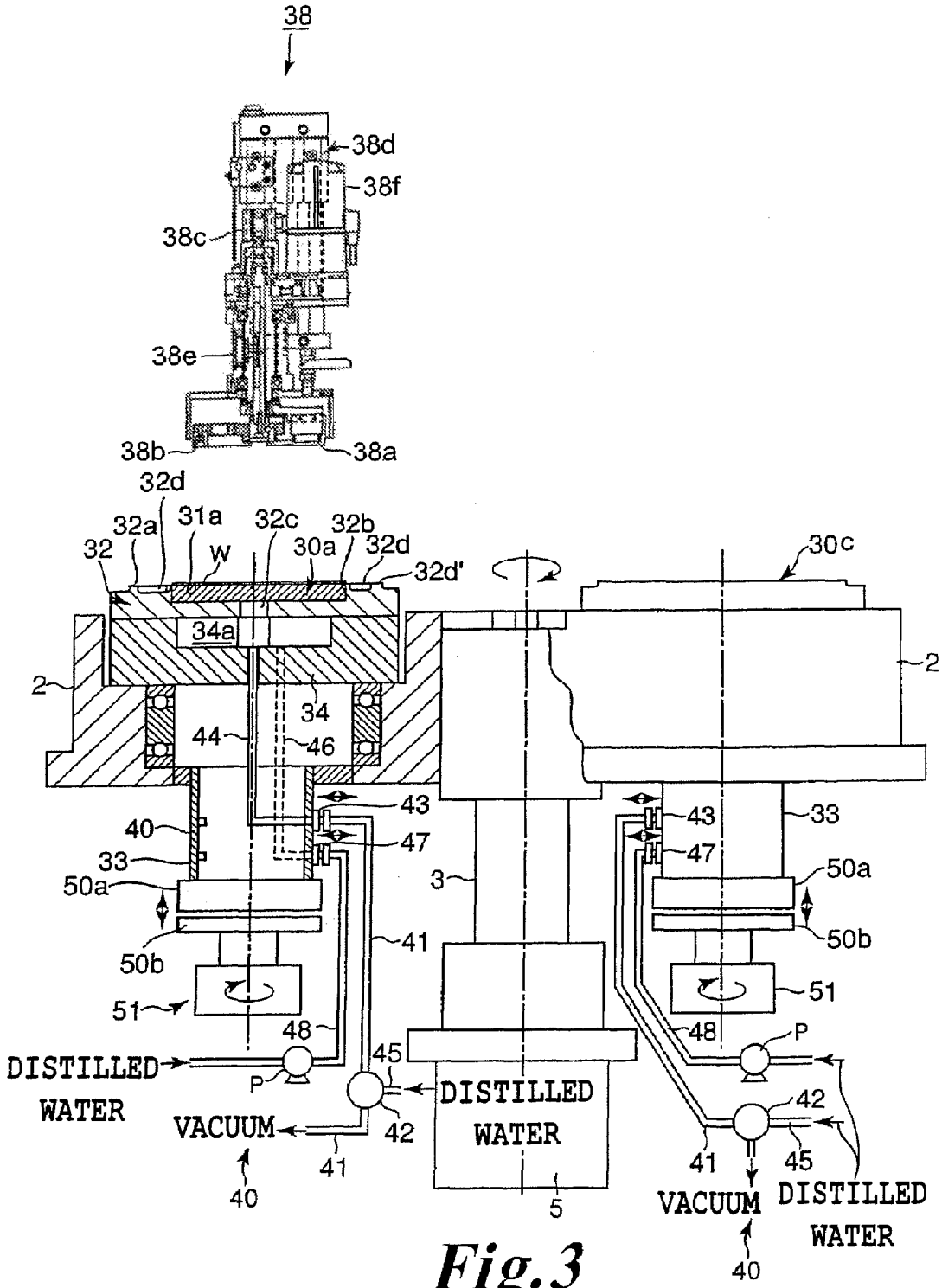
FIG. 3 is a cross-sectional diagram that is a cutout part of the substrate holder table (vacuum chuck) set on the first index rotary table.

The rotary chuck cleaner 38*a*, which cleans the top surface 31*a* of the substrate holder table 30*a* and the cleaning device 38 shown in FIG. 3 comprising a pair of rotary cleaning brushes 38*b*, which clean the surface of the ground substrates, is configured to be movable in the directions perpendicular and parallel to the top surface of the substrate holder table in the top of the substrate holder table 30*a*, which composes the substrate loading/unloading stage $S_1$ set in the first index rotary table 2.

Returning to FIG. 1 and FIG. 2, the spindle 90*b* comprising a rough grinding diamond cup wheel 90*a*, is set on top of the substrate holder table 30*b*, which composes the rough grinding stage $S_2$, so as to be able to move up-and-down in relation to the top surface of the substrate holder table. The spindle 91*b* comprising the finish grinding diamond cup wheel 91*a*, is set on top of the substrate holder table 30*c*, which composes the finish grinding stage $S_3$, and is configured to move up-and-down in relation to the top surface of the substrate holder table. The supporting panels 90*c*, 91*c* of each spindle 90*b* and 91*b* are able to move up-and-down along the supporting guides 90*e*, 91*e* by the supporting panels 90*c*, 91*c*, which are screwed together with the rotary driving ball screw, which is driven by the motors 90*d* and 91*d*. Item 6 in the drawing is a two-point indication substrate thickness measuring device.

The substrate loading/unloading stage $S_1$ is composed of the substrate holder table 30*a*, the multi-joint transfer robot 14, the movable transfer pad 16, and the cleaning device 38 comprising the rotary chuck cleaner and the rotary cleaning brush. The rough grinding stage $S_2$ is composed of the substrate holder table 30*b*, the rough grinding diamond cup wheel 90*a*. The finish grinding stage $S_3$ is composed of the substrate holder table 30*c* and the finish grinding diamond cup wheel 91*a*. The substrate loading/unloading stage $S_1$ can be called a cleaning stage, because cleaning of the substrates and the substrate holder table 30*a* is carried out here.

It is preferred to use a resin bond diamond wheel of grit grain size (JIS general abrasive grain size) 800-1,800 as the rough grinding diamond cup wheel 90*a* and a metal bond diamond wheel or a vitrified bond diamond wheel of grit grain size 2,000-8,000 as the finish grinding diamond cup wheel.

FIG. 3 indicates the structure of the substrate holder tables (vacuum chuck) 30*a*, 30*c*, which are set in the first index rotary table 2 of the grinding process stage 20 and the structure of the cleaning device 38. In FIG. 3, 3 is the rotating shaft of the first index rotary table 2, 5 is the drive motor of the rotating shaft 3. Each of the substrate holder table 30*a*, 30*b*, and 30*c* are typically arranged 120 degrees equally spaced on the same circumference on the first index rotary table 2.

In this example of a substrate holder table 30*a* shown in FIG. 3, substrate holder table (vacuum chuck) 30*a* has a porous ceramic disciform placing base 31*a*, whose diameter is approximately the same as the diameter of the work w, placed on the nonporous material supporting base 32. The nonporous material supporting base has two levels of large and small circular empty spaces 32*b*, 32*c* on the upper part, so as that the top surface of the porous ceramic disciform placing base 31*a* and the top surface 32*a* of the nonporous material supporting base 32 becomes one surface, and as this nonporous material supporting base 32 is axially supported by the suspended spindle 33 so as to freely rotate via the concaved top surface supporting frame 34. A system vacuum 40, which decompresses the circular empty spaces 32*b*, 32*c* of the nonporous material supporting base in the bottom surface of the porous ceramic disciform placing base is connected to the empty spaces 32*b* and 32*c*.

On the top surface of the circular side wall 32*a* of the nonporous material supporting base 32, which is attached to the surface of the external wall of the porous ceramic disciform placing base 31, an annular groove 32*d* is set at a shallow depth. The bottom surface of the nonporous material-supporting base 32 is typically fixed to the concaved top surface supporting frame 34 with a bolt, and the bottom part of the concaved top surface supporting frame 34 is axially supported by the suspended spindle 33. The clutch mechanisms 50*a* and 50*b* are installed in the bottom part of the suspended spindle 33, and the drive motor 51 is installed in the clutch panel 50*b* of the bottom part. When the clutch panels 50*a* and 50*b* are connected, the suspended spindle 33 begins to rotate by receiving torque from the drive motor 51, and the concaved supporting frame 34, which is axially supported by the spindle shaft and the porous ceramic disciform placing base 31 are also rotated by receiving the rotary drive force from the drive motor 51.

The vacuum system 40 is composed of a vacuum pump, which is not shown in the drawing, and linked to the pump, piping 41, switching valve 42, rotary joint 43, and pipe 44, are linked to the rotary joint 43. The pipe 44 is typically inside the spindle 33. The switching valve 42 is linked to the pipe 45, which supplies distilled water.

In addition, in the suspended spindle 33, the pipe 46, which leads to the concave area 34*a* of the concaved top surface supporting frame 34, is arranged and connected to the pump P, which feeds distilled water for cooling via a pipe 48 linked to the rotary joint 47. The distilled water fed to the concave area 34*a* of the concaved supporting frame 34 cools the base area of the nonporous material-supporting base 32.

By running the vacuum system 40, the semiconductor substrate w placed on a porous ceramic disciform placing base 31*a* is decompressed and fixed on the porous ceramic disciform placing base 31*a* facing the substrate. When the switching valve 42 is switched to the distilled water feeding side after stopping the vacuum of the vacuum procedure 40, the pressurized distilled water cleans the porous ceramic disciform placing base 31*a*.

Japanese Unexamined Patent Publication No. 2005-44874, incorporated herein by reference, describes the cleaning device 38 comprising a pair unit of the rotary ceramic chuck cleaner 38 for cleaning the top surface of the substrate holder 30*a* and the rotary cleaning brush 38*b* for cleaning the ground surface of the substrate, the suspended spindle up-and-down mechanism 38*c*, unit up-and-down mechanism 38*d*, the suspended spindle 38*e* for passing cleaning fluid, and the suspended spindle rotating motor 38*f*.

Again, returning to FIG. 1 and FIG. 2, the polishing process stage 70 is set on the left side of the multi-joint transfer robot 14. The polishing process stage 70 arranges the substrate holder table 70*a*, which composes the substrate loading/unloading/finish polishing stage $ps_1$, and the substrate holder table 70*b*, which composes the rough polishing stage $ps_2$, symmetrically on the same circumference on the second index rotary table 71. On the top of the substrate holder table 70*a* of the finish polishing stage, the spindle 74, which axially supports so as to freely rotate the cleaning fluid feeding mechanism 72 and the finish polishing pad 73 is installed so as to be able to move up-and-down and oscillate as shown in (FIG. 2) or linearly vacillate as shown in (FIG. 1) parallel to the top surface of the substrate holder table 70*a*. In the substrate holder table 70*a*, the finish polishing pad 73, the cleaning fluid feeding mechanism 72, the movable transfer pad 16, and the transferring equipments installed in the next mounting stage, which is not shown in the drawing, compose the substrate loading/unloading/finish polishing stage $ps_1$. For installation of the substrate loading/unloading/finish polishing stage $ps_1$ and the rough polishing stage $ps_2$, the substrate loading/unloading/finish polishing stage $ps_1$ is set closer to the transfer location of the next stage. Therefore, the substrate loading/unloading/finish polishing stage $ps_1$ is set close to the grinding stage 20 in the planarizing device of FIG. 1, and the substrate loading/unloading/finish polishing stage $ps_1$ is set further away from the grinding stage 20 in the planarizing device of FIG. 2. The substrate loading/unloading/finish polishing stage $ps_1$ can be called a cleaning stage for cleaning substrates.

The abrasive slurry fluid feeding mechanism 72' and the spindle 74 that is axially supported so as to enable the polishing pad 73' to freely rotate set on top of the substrate holder table 70*b* composes the rough polishing stage ps2 so as to be able to move up-and-down and oscillate or linearly vacillate parallel to the top surface of the substrate holder table 70*b*. The substrate rough polishing stage ps2 is comprised with this substrate holder table 70*b*, the rough polishing pad 73', and the abrasive slurry fluid feeding mechanism 72'. The pad conditioner 75 is set on the vacillating trajectory of the rough polishing pad 73' of the substrate loading/unloading/finish polishing stage $ps_1$, as the bottom surface of the rough polishing pad 73' is ground by the grinding stone 75*a* to make it smooth, the cleaning fluid 75*b* is fed to the surface of the rough polishing pad to clean. Although it is not indicated in the figure, another pad conditioner 75 can be installed on top of the vacillating trajectory of the finish polishing pad 73, when needed.

As an abrasive slurry fluid, slurry is used, in which abrasive grains such as colloidal silica, cerium oxide, alumina, boehmite, and manganese dioxide are dispersed in purified water, typically distilled water. When necessary, surfactants, chelating agents, pH adjuster, oxidizing reagents, and antiseptic agents are blended into the slurry. The polishing slurry is fed to the surface of the abrasive cloth at a rate of 50-1,500 cc per minute.

Pure water, distilled water, deep-sea water, deionized-exchange water, and pure water containing surfactants can be used as cleaning fluid.

In the planarizing device, shown in FIG. 2, the rough polishing pad 73' and the finish polishing pad 73 are rotatably fixed to the front of the arm 77 supported by the rotating shaft 76. By the rotation of the rotating shaft 76, it can back down to the location of the polishing pad (ready position) indicated by a fictive line in FIG. 2. In one non-limiting embodiment, the rotation speed of the polishing head 70*a*, 70*b* is 10-150 rpm, the rotation speed of the substrate holder table 70*a*, 70*b* is 10-150 rpm, the pressure applied to the substrate by the polishing pad is 0.05-0.3 $kg/cm^2$, but preferably 100-200 $g/cm^2$.

Figure 4:
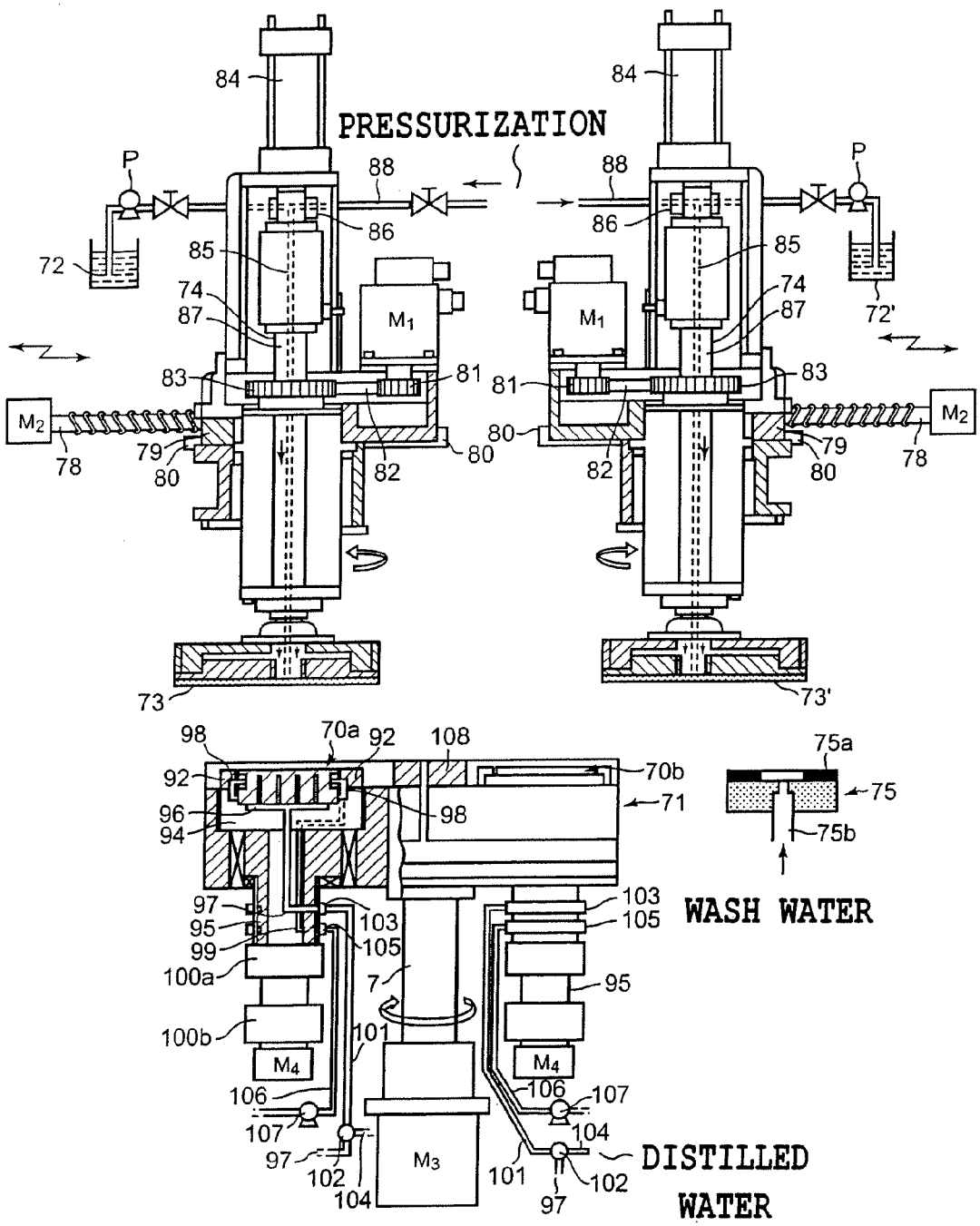
FIG. 4 is a side view of a cutout part of the polishing stage.
Figure 5:
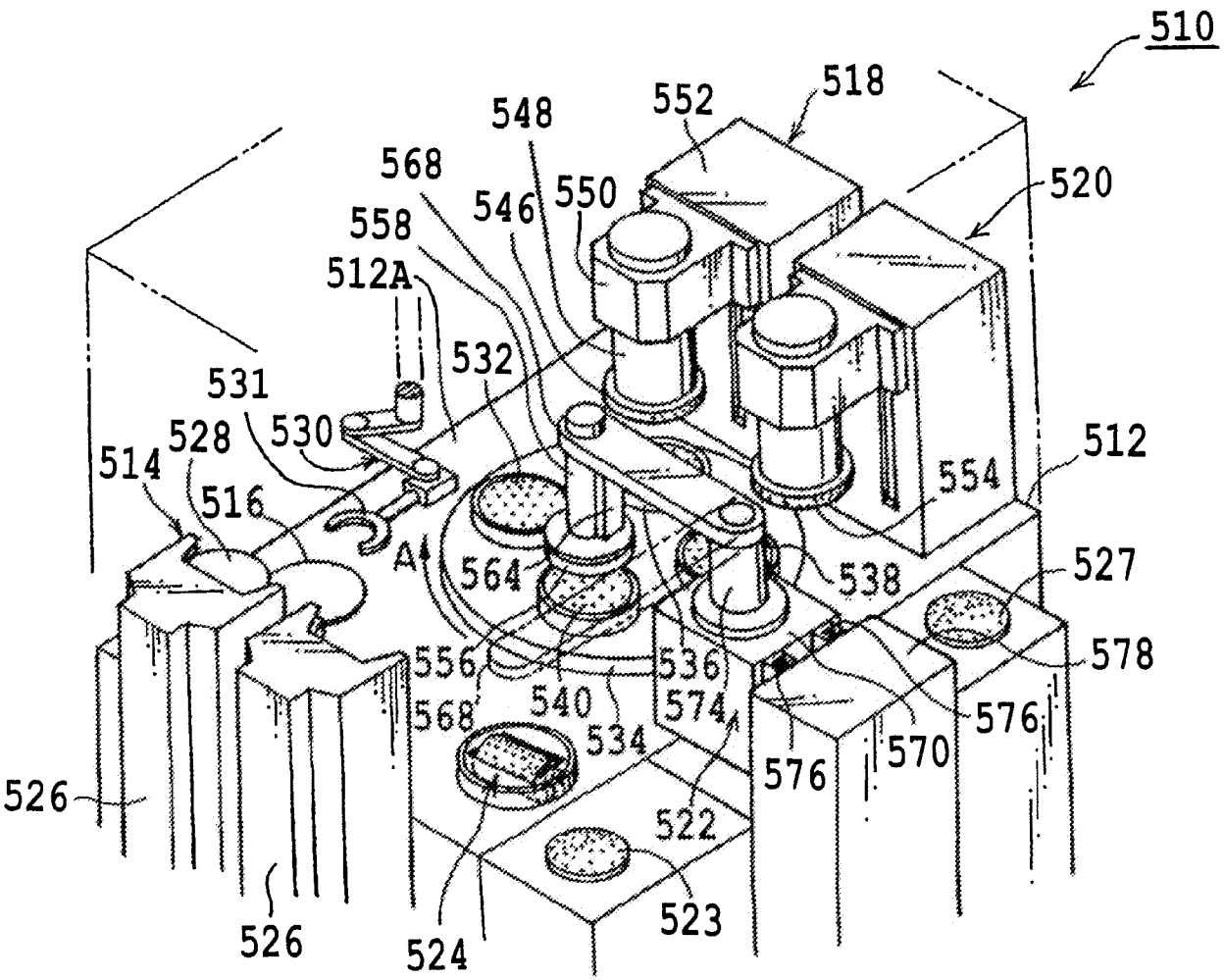
BACKGROUND ART Fig.5
FIG. 5 is a perspective view of a background planarizing device.
Figure 6:
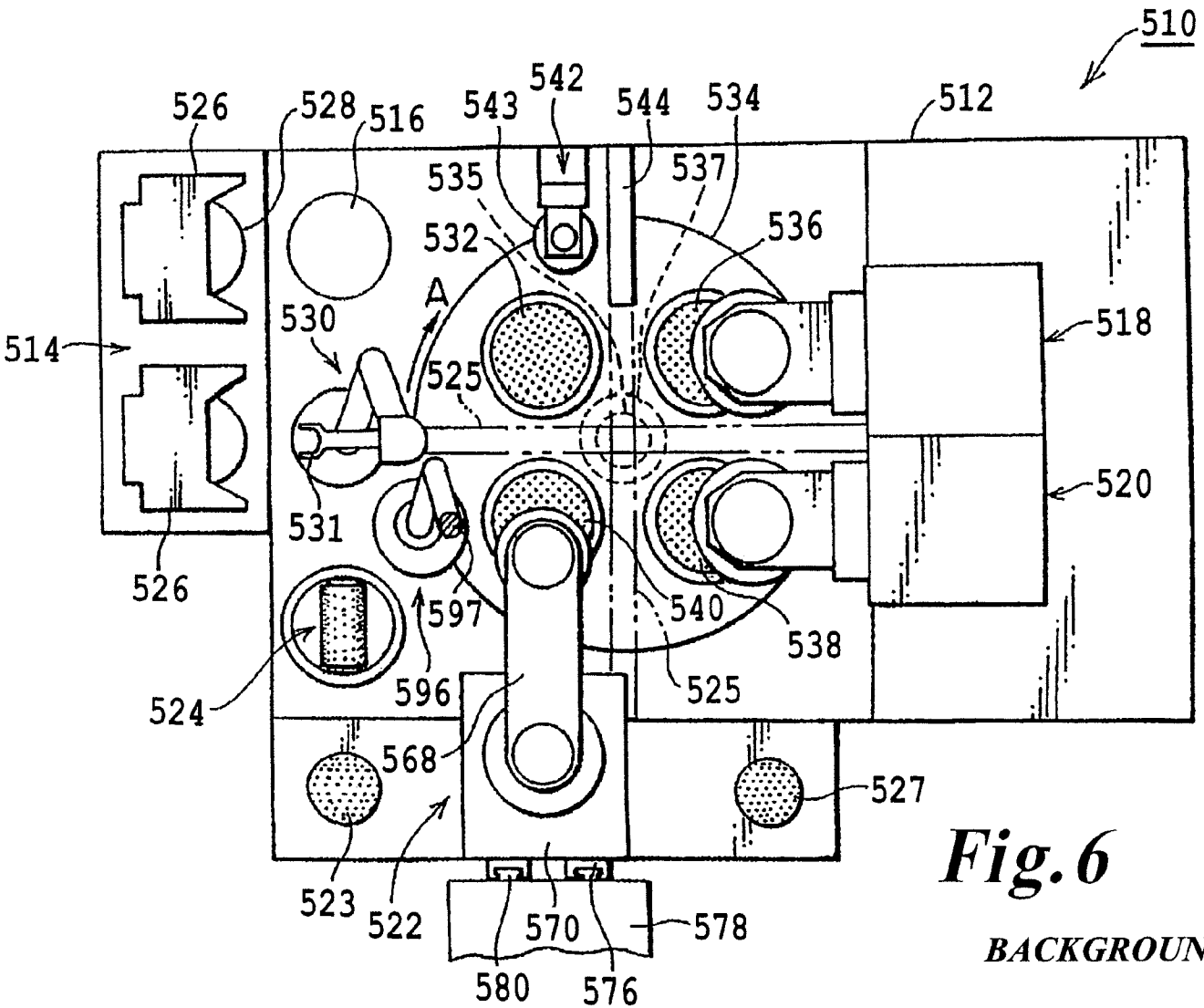
Fig. 6 BACKGROUND ART
FIG. 6 is a plan view of the background planarizing device.

The polishing pads 73, 73' of the polishing process stage 70 disclosed in FIG. 1 and FIG. 4 can back down to the location of the polishing pad (ready position) indicated by a dashed line, by the linearly vacillating the suspended spindle 74 that axially supports the polishing pad on the substrate holder table 70*a*, 70*b* with back and forth motion along the linear guide 80 of the threadably mounted body 79, which is mounted to the ball screw 78 rotated by the motor M2. The rotation of the suspended spindle 74 is operated by rotating the suspended spindle 74 with the rotary drive of the motor M1 via the pulley 81 and pulley 83 via the belt 82. The perpendicular movement of the suspended spindle 74 is accomplished with the air cylinder 84. The fluid feeding pipe 85 is typically installed in the center of the suspended spindle 74, and is typically connected to the rotary joint 86, and further connected to the cleaning fluid feeding mechanism 72 or the abrasive slurry fluid feeding mechanism 72'. In the dead space 87 formed with the inside of the suspended spindle 74 and the outside of the fluid feeding pipe 85, the pressurized air feeding pipe 88 is connected via the rotary joint 86.

The structure of the second index rotary table 71 of the polishing stage 70 is similar to the structure of the first index rotary table 2 of the grinding stage 20, except the point with 2 tables of the substrate holder table 70*a*, 70*b*. In other words, in FIG. 4, the substrate holder table (vacuum chuck) 70*a*, 70*b* have a perforated (pore diameter is 0.3-1 mm) ceramic disciform placing base 70*a*, 70*b*, whose diameter is approximately the same as the diameter of the work w, placed on the nonporous material supporting base 92, so that the top surface of the perforated ceramic disciform placing base 70*a*, 70*b* and the top surface of the nonporous material supporting base 92 becomes one surface. As this nonporous material supporting base 92 is axially supported by the suspended spindle 95 so as to freely rotate via the concaved top surface supporting frame 94, the vacuum procedure 97, which evacuates the circular empty space 96 of the nonporous material supporting base in the bottom surface of the perforated ceramic disciform placing base is operated. The substrate holder table 70*a*, 70*b* are axially supported by the spindle 7, and the spindle can rotate by receiving the drive from the motor $M_3$. The substrate holder table (perforated ceramic disciform placing base) 70*a*, 70*b* can be the same type of porous ceramic disc used in the grinding stage.

An annular groove 98 is located in the area of circular inside wall of the nonporous material supporting base 92, which is attached to the external wall surface of the perforated ceramic disciform placing base 70*a*, 70*b*, and cooling water 99 is fed into the annular groove 98. The bottom surface of the nonporous material supporting base 92 is fixed to the concaved top surface supporting frame 94 by a bolt, and the bottom area of the concaved top surface supporting frame 94 is axially supported by the suspended spindle 95. The clutch mechanism 100*a*, 100*b* are installed in the bottom area of the suspended spindle 95, and the drive motor $M_4$ is installed in the lower area of the clutch panel 100*b*. When the clutch panels 100*a*, 100*b* are connected, the suspended spindle 95 begins to rotate by receiving torque from the drive motor $M_4$, and the concaved supporting frame 94 and the perforated ceramic disciform placing base 70*a*, 70*b* that are axially supported by the spindle shaft are also rotated by the rotary drive force.

The vacuum system 97 is composed of a vacuum pump, which is not shown in the drawing, and piping 101, switching valve 102, and rotary joint 103 that are linked to the pump, and the pipe 97, which is typically positioned inside the suspended spindle 95 linked to the rotary joint. The switching valve 102 is linked to the pipe 104, which feeds purified water, typically distilled water.

Moreover, the pipe 99, which leads to the annular groove 98 set in the area of circular inside wall of the nonporous material supporting base 92, is arranged inside of the suspended spindle 95, and it is connected to the pump 107 that feeds water for cooling via the pipe 106 that links to the rotary joint 105.

By running the vacuum procedure, the semiconductor substrate w, which is placed on top of the perforated ceramic disciform placing base 70*a*, 70*b* are decompressed and fixed to the perforated ceramic disciform placing base 70*a*, 70*b* facing the surface of the substrate upward. When the switching valve 102 is switched to the distilled water feeding side after stopping the vacuuming of the vacuum system, pressurized distilled water cleans the perforated ceramic disciform placing base 70*a*, 70*b* (so-called back flush).

In the substrate loading/unloading/finish polishing stage $ps_1$ and the rough polishing stage $ps_2$ of the polishing stage 70, scattered abrasive slurry fluid or cleaning fluid are not scattered in the opposite stage due to the existence of a dividing dike 108 that is situated on the second index rotary table 71.

In one non-limiting embodiment, the planarizing device 10 shown in FIG. 1 is a device that is able to thin/planarize the back surface of a 300-mm diameter semiconductor substrate at 25 sheets per hour throughput, and has a footprint of a maximum room width of 1,355 mm and a maximum length of the front back row of room of 3,650 mm. In one non-limiting embodiment, the footprint of the 300 mm diameter semiconductor substrate back surface planarizing device 10 shown in FIG. 2 has a maximum width of 2,000 mm, and has a maximum length of 3,650 mm.

In one non-limiting embodiment, operation of thinning/planarizing the back surface of the semiconductor substrate using the planarizing device 10 for the substrate shown in FIG. 1 or FIG. 2 is performed via the following processes.

1) Seize the semiconductor substrate w, which is stored inside the storage cassette of the substrate storage stage 13 with the suction pad 14*a* of the multi-joint transfer robot 14, transfer to the top of the temporary alignment platform 15, and position the semiconductor substrate in the center.

2) Suck or grip the top surface of the aligned substrate to the suction pad 14*a* of the multi-joint transfer robot, and transfer onto the substrate holder table 30*a*, which composes the substrate loading/unloading stage $S_1$ set on the first index rotary table 2.

3) By rotating the first index rotary table 2 120° clockwise, transfer the substrate, which is vacuum chucked to the substrate holder table 30*a* in the location of the substrate loading/unloading stage $S_1$ to the location of the substrate holder table 30*b* of the rough grinding stage $S_2$.

4) Rough grind the back surface of the substrate, which is transferred to the rough grinding stage $S_2$ using the diamond cup wheel 90*a*. Meanwhile, the first and second processes are performed using the multi-joint transfer robot 14, and the new substrate W is transferred to the top of the substrate loading/unloading stage $S_1$.

5) By rotating the first index rotary table 2 120° clockwise, transfer the rough ground substrate to the location of the substrate holder table 30*c* of the finish grinding stage $S_3$, and transfer the substrate on the substrate holder table 30*a* in the location of the substrate loading/unloading stage $S_1$ to the rough grinding stage $S_2$.

6) Finish grind the back surface of the rough ground substrate using the diamond cup wheel 91*a* in the finish grinding stage $S_3$. Meanwhile, the back surface of the substrate is the rough ground using the diamond cup wheel 90*a* in the rough grinding stage $S_3$, and new substrate is transferred to the top of the substrate holder 30*a* in the location of the substrate loading/unloading stage $S_1$ via the temporary alignment platform 15 using the multi-joint transfer robot 14.

7) By rotating the first index rotary table 2 120° clockwise or 240° counterclockwise, the finish ground substrate is transferred to the top of the substrate loading/unloading stage $S_1$, and the rough ground substrate is transferred to the finish grinding stage $S_3$.

8) Decline the rotary cleaning brush 38*b* to the top surface of the finish ground substrate on the substrate holder table 30*a* in the location of the substrate loading/unloading stage $S_1$ of the first index rotary table 2, and clean the top surface of the substrate while the cleaning fluid is supplied, followed by seizing the top surface of the ground/cleaned substrate to the surface of the suction pad 16*a* of the movable transfer pad 16, and then after linearly transferring or rotary transferring to the location indicated by the dashed line, and moving again to transfer the substrate on top of the substrate holder table 70*a* in the location of the substrate loading/unloading/finish polishing stage $ps_1$ set in the second index rotary table 71. While transferring the substrate, the top surface of the substrate holder table 30*a* in the location of the substrate loading/unloading stage $S_1$ of the first index rotary table 2 is cleaned by the rotary ceramic chuck cleaner 38*b*. After cleaning the top surface of the substrate holder 30*a*, the first process and second process are performed, wherein a new substrate is transferred to the top of the substrate holder table 30*a* in the location of the substrate loading/unloading stage $S_1$ via the temporary alignment platform 15 by the multi-joint transfer robot 14. Moreover, the rough grinding of the forth process is performed on the substrate on top of the substrate holder table 30*b* in the location of the rough grinding stage $S_2$ of the first index rotary table, and at the same time, the finish grinding of the sixth process is performed on the substrate on top of the substrate holder table 30*c* in the location of the finish grinding stage $S_3$ of the first index rotary table.

9) After the rough grinding process of the substrate, the second index rotary table 71 is rotated 180° clockwise or counterclockwise, and the ground/cleaned substrate is transferred to the location of the rough polishing stage $ps_2$ set in the second index rotary table. The seventh process is performed in parallel with this operation.

10) The rotating rough polishing pad 73' is lowered to the top surface of the substrate, which is retained on the substrate holder table 70*b* in the location of the rough polishing stage $ps_2$ set in the second index rotary table 71 to rub the surface of the substrate. While the substrate is rubbed by the rough polishing pad, the abrasive slurry fluid 72', in which abrasive grains are dispersed in water is fed from an abrasive slurry fluid feeding mechanism to the top surface of the substrate via the polishing cloth of the rough polishing pad or the urethane foam sheet pad, and meanwhile, the rough polishing pad 73' is oscillating or vacillating linearly. The abovementioned eighth process is implemented simultaneously.

11) The second index rotary table 71 is rotated 180° clockwise or counterclockwise, and the rough polished substrate is transferred to the location of the substrate loading/unloading/finish polishing stage $ps_1$ of the second index rotating table 71. By concurrently rotating the first index rotating table 2 120° clockwise or 240° counterclockwise, the finish ground substrate is transferred to the top of the substrate loading/unloading stage $S_1$, the rough ground substrate is transferred to the finish grinding stage $S_3$, and the substrate on the substrate loading/unloading stage S1 is transferred to the rough grinding stage $S_2$.

12) At the substrate loading/unloading/finish polishing stage $ps_1$ of the second index rotary table 71, the rotating finish polishing pad 73 is declined to the top surface of the rough polished substrate retained on the substrate holder table 70*a*, and the surface of the substrate is rubbed. While the substrate is rubbed by the finish polishing pad, the cleaning fluid 72, such as distilled water that does not contain abrasive grain, is fed to the top surface of the substrate from the cleaning fluid feeding mechanism via the polishing cloth or urethane foam sheet pad of the finish polishing pad 73 to the top surface of the substrate, and meanwhile, the finish polishing pad is vacillating. The finish polished substrate is transferred to the next processing stage using substrate transfer equipment having suction pads on its arm, or by a multi-joint transfer robot. After emptying the substrate holder table 70*a* in the location of the substrate loading/unloading/finish polishing stage $ps_1$ of the second index rotary table 71, the ground/cleaned substrate on the substrate holder table 30*a* in the location of the substrate loading/unloading stage $S_1$ of the first index rotary table 2 is seized or gripped with the movable suction/gripping pad 16 and transferred to the top of the substrate holder table 70*a* located in the substrate loading/unloading/finish polishing stage ps1 set on the second index rotary table 71. The abovementioned tenth process including the eighth process is implemented concurrently at each stage $S_1$, $S_2$, and $S_3$ of the first index rotary table 2 and the rough polishing stage $ps_2$ of the second index rotary table 71.

13) Hereafter, perform the operation of thinning/planarizing semiconductor substrate by grinding/cleaning/polishing the surface of the substrates consecutively by repeating the eleventh process and the twelfth process.

As a different aspect of the thinning/planarizing method using the substrate-planarizing device of the present invention, it is possible to transfer the ground/cleaned substrates with the movable suction pad 16 directly on top of the substrate holder table 70*b* in the location of the rough polishing stage $ps_2$, rough polish the substrate in the stage $ps_2$, transfer the substrate to the location of the by the substrate loading/unloading/finish polishing stage $ps_1$ by rotating the second index rotary table 71 180°, and finish polish the substrate in the stage $ps_1$.

The planarizing device of the semiconductor substrate of the present invention has a compact footprint, and is able to grind/polish back surface of the semiconductor substrates in high throughput.

Numerous modifications and variations of the present invention are possible in light of the above teachings. It is therefore to be understood that within the scope of the appended claims, the invention may be practiced otherwise than as specifically described herein.

The invention claimed is:

1. A semiconductor substrate planarizing device, comprising:

a substrate storage stage at least partially outside a room;

a multi-joint transfer robot;

a temporary alignment platform;

a grinding process stage;

a movable transfer pad;

a polishing process stage; and a cleaning stage inside the room, wherein the substrate storage stage is set on the first side of the outside of the room, facing the rear of the planarizing device, inside the room, the multi-joint transfer robot is situated such that the multi-joint transfer robot can reach and remove substrates from the substrate storage stage in a front row inside of the room, the temporary alignment platform is situated on a first side of the row behind the multi-joint transfer robot, and the movable transfer pad is situated in a center of a back row, and the grinding process stage, which has first, second, and third substrate holder tables, comprising 1) a substrate loading/unloading stage, 2) a rough grinding stage, and 3) a finish grinding stage, respectively, set in a clockwise direction arranged in a concentric pattern on a first index rotary table in a last row, a cleaning device comprising a rotary chuck cleaner configured to clean a top surface of the first substrate holder table, and a pair of rotary cleaning brushes configured to clean the surface of a ground substrate, is configured to be moved in perpendicular and parallel directions relative to the top surface of the first substrate holder table, a spindle comprising a rough grinding diamond cup wheel is set on top of the second substrate holder table and is configured to move up-and-down with respect to the top surface of the second substrate holder table, a spindle comprising a finish grinding diamond cup wheel is set on top of the third substrate holder table and is configured to move up-and-down in relation to the top surface of the third substrate holder table, and wherein the substrate loading/unloading stage includes the first substrate holder table, a multi-joint transfer robot, a movable transfer pad, and a cleaning device comprising a rotary chuck cleaner and a rotary cleaning brush;

the rough grinding stage includes the second substrate holder table and a rough grinding diamond cup wheel; and the finish grinding stage includes the third substrate holder table and a finish grinding diamond cup wheel, a polishing process stage, in which a fourth substrate holder table comprising a substrate loading/unloading/finish polishing stage and fifth substrate holder table comprising a rough polishing stage are arranged in a concentric pattern on a table of a second index rotary table on a second side of the multi-joint transfer robot, opposite the first side, wherein a spindle, that axially supports a cleaning fluid feeding mechanism and a polishing pad so as to permit the cleaning fluid feeding mechanism and polishing pad to rotate freely, is set on top of the fourth substrate holder table and is configured to move up-and-down and vacillate parallel to the top surface of the fourth substrate holder table, and a substrate loading/unloading/finish polishing stage includes the fourth substrate holder table, a polishing pad, a cleaning fluid feeding mechanism, the movable transfer pad and the multi-joint transfer robot or another transfer pad or another multi-joint transfer robot, and a spindle, that axially supports an abrasive slurry fluid feeding mechanism and the polishing pad so as to permit them to rotate freely, is set on top of the fifth substrate holder table and is configured to move up-and-down and vacillate parallel to the top surface of the second substrate holder table.

2. The semiconductor substrate planarizing device according to claim 1, wherein the first side is a right side when viewed from a side of the semiconductor substrate planarizing device where the substrate storage stage is installed.

3. The semiconductor substrate planarizing device according to claim 1, wherein the substrate storage stage penetrates the wall.

4. A method of thinning/planarizing a back surface of a semiconductor substrate using the substrate planarizing device according to claim 1, the method comprising the following processes:

1) seizing a substrate that is stored in a storage cassette of the substrate storage stage with a suction pad of the multi-joint transfer robot, and transferring the substrate to a temporary alignment platform to control a center position of the substrate such that a center of the substrate is aligned;

2) seizing a top surface of the aligned substrates with the suction pad of the multi-joint transfer robot, and then transferring the substrate to the top of the first substrate holder table;

3) by rotating the first index rotary table, transferring a vacuum chucked substrate on the substrate holder table located in the substrate loading/unloading stage to the second substrate holder table;

4) roughly grinding the back surface of the substrate using diamond cup wheels in the rough grinding stage, wherein process 1) and process 2) are performed using the multi-joint transfer robot during this stage, and new substrates are transferred to the substrate loading/unloading stage;

5) by rotating the first index rotary, transferring the roughly ground substrates to the third substrate holder table, and at the same time, transferring the substrate on the first substrate holder table to the rough grinding stage;

6) finish grinding the back surface of the substrate using diamond cup wheels in the finish grinding stage, wherein the back surface of the substrate is roughly ground using the diamond cup wheels in the rough grinding stage during this stage, and at the same time, new substrates are transferred by the multi-joint transfer robot to the top of the first substrate holder table via a temporary alignment platform;

7) by rotating the first index rotary table, transferring the finish ground substrate to the substrate loading/unloading stage, and transferring the roughly ground substrate to the finish grinding stage;

8) by moving a rotary cleaning brush to the top surface of the finish ground substrate on the first substrate holder table, cleaning the top surface of the substrate by supplying cleaning fluid to the top surface of the substrate, and then seizing the ground/cleaned top surface of the substrates with the suction pad of the movable transfer pad, and then transferring to the top of the fourth substrate holder table, which is set in the second index rotary table, wherein while these substrates are transferred, the top surface of the first substrate holder table is cleaned by a rotary ceramic chuck cleaner, and after cleaning the top surface of the substrate holder, the abovementioned first process and second process are initiated consecutively, in which the new substrate is transferred to the top of the substrate holder table in the location of the substrate loading/unloading stage via the temporary alignment platform by the multi-joint transfer robot, in addition, the fourth process of rough grinding is performed on the substrates on top of the substrate holder table in the location of the rough grinding stage of the first index rotary table, and at the same time, the sixth process of finish grinding is performed on the substrate on top of the substrate holder table in the location of the finish grinding stage of the first index rotary table;

9) after the rough grinding process of the substrates, rotating the second index rotary table 180° clockwise or counterclockwise, and transferring the ground/cleaned substrate to the location of the rough polishing stage of the second index rotary table, wherein the abovementioned seventh process is implemented simultaneously with this operation;

10) moving the rotating rough polishing pad to the top surface of the substrate on top of the substrate holder table in the location of the rough polishing stage set on the second index rotary table, and rubbing the surface of the substrates, wherein while the substrate and the rough polishing pad are rubbed, abrasive slurry fluid, in which abrasive grains are dispersed in water, is fed directly from an abrasive slurry fluid feeding mechanism to the top surface of the substrate, or via the rough polishing pad to the top surface of the substrate, and at the same time, the rough polishing pad rubs while vacillating on the top surface of the substrate, and the abovementioned eighth processing is implemented simultaneously;

11) rotating the second index rotary table, and transferring the roughly ground substrate to the location of the substrate loading/unloading/finish grinding stage of the second index rotary table at the same time, by rotating the first index rotary table, transporting the finish ground substrate to the substrate loading/unloading stage, transporting the roughly ground substrate to the finish grinding stage, and transporting the substrate on the substrate loading/unloading stage to the rough grinding stage;

12) at the substrate loading/unloading/finish grinding stage of the second index rotary table, moving the rotating finish polishing pads to the top surface of the rough polished substrate retained on the substrate holder table, and rubbing the surface of the substrate, wherein while the substrate and the finish polishing pad are rubbed, cleaning fluid, which does not contain abrasive grain, is fed to the top surface of the substrates directly from the cleaning fluid feeding mechanism, or fed via a polishing cloth or a urethane foam sheet pad of the finish polishing pad to the top surface of the substrate while the finish polishing pad are vacillating, the finish polished substrate is transferred to the next processing stage using substrate transfer equipment having a suction pad on an arm, or the multi-joint transfer robot; seizing the ground/cleaned substrates on the substrate holder table in the location of the substrate loading/unloading stage of the first index rotary table with the movable suction pad after emptying the substrate holder table in the location of the substrate loading/unloading/finish grinding stage of the second index rotary table, and then transferring to the top of the substrate holder table located in the substrate loading/unloading/finish grinding stage set on the second index rotary table, wherein the abovementioned tenth process including the eighth process is implemented concurrently at each stage of the first index rotary table and the rough polishing stage of the second index rotary table; and 13) afterward, the repeating abovementioned eleventh process and the twelfth process to perform consecutive operations of thinning and planarizing substrates by grinding/cleaning/polishing the substrate surface of the semiconductor substrates.

5. The method according to claim 4, wherein an amount of rotation in process 3 is 120°.

6. The method according to claim 5, wherein the rotation is in a clockwise direction as viewed from above.

7. The method according to claim 4, wherein the rotation of the first index rotary table in process 5 includes rotating the first index table 120° clockwise as viewed from above.

8. The method according to claim 4, wherein the rotation of the first index rotary table in process 7 includes rotating the first index table 120° in a clockwise direction as viewed from above.

9. The method according to claim 4, wherein the rotation of the first index rotary in process 7 includes rotating the first index table 240° in a counterclockwise as viewed from above.

10. The method according to claim 4, wherein the rotation of the first index rotary table in process 11 is 120° in a clockwise direction as viewed from above.

11. The method according to claim 4, wherein the rotation of the first index rotary table in process 11 is 240° in a counterclockwise direction as viewed from above.

12. The method according to claim 4, wherein the rotation of the second index rotary table in process 11 includes rotating the second index rotary table 180° clockwise or counterclockwise as viewed from above.

* * * * *